United States Patent [19]

Harvey

[11] 4,001,469

[45] Jan. 4, 1977

[54] METHOD OF SEALING POROUS MATERIAL DEFINING A RECESS

[75] Inventor: Jay A. Harvey, East Amherst, N.Y.

[73] Assignee: Great Lakes Carbon Corporation, New York, N.Y.

[22] Filed: May 27, 1975

[21] Appl. No.: 580,775

[52] U.S. Cl. ..... 427/238; 118/50; 118/408

[51] Int. Cl.[2] ..... B05C 7/00

[58] Field of Search ..... 118/50, 408, 400; 52/744; 427/133, 134, 140, 238, 230, 294–295, 296, 297, 298; 425/242 R, 256, 12, 13; 164/98, 106, 107

[56] References Cited

UNITED STATES PATENTS

| | | | |
|---|---|---|---|
| 39,589 | 8/1863 | Robinson | 118/408 |
| 2,074,566 | 3/1937 | Sheils | 52/744 |
| 2,670,511 | 3/1954 | Hadley | 164/98 X |
| 2,963,827 | 12/1960 | Ganton | 52/744 X |
| 3,310,427 | 3/1967 | Cheney et al. | 164/98 X |

FOREIGN PATENTS OR APPLICATIONS

| | | | |
|---|---|---|---|
| 29,051 | 9/1957 | Finland | 52/744 |

*Primary Examiner*—Morris Kaplan
*Attorney, Agent, or Firm*—Carl F. Peters

[57] ABSTRACT

A method of and apparatus for sealing porous material defining a recess therein by placing sealing liquid in the recess, inserting a tubular means therein, pressure sealing said means with respect to the recess and forcing said sealing liquid into the pores by a gaseous pressure applied through said tubular means.

2 Claims, 1 Drawing Figure

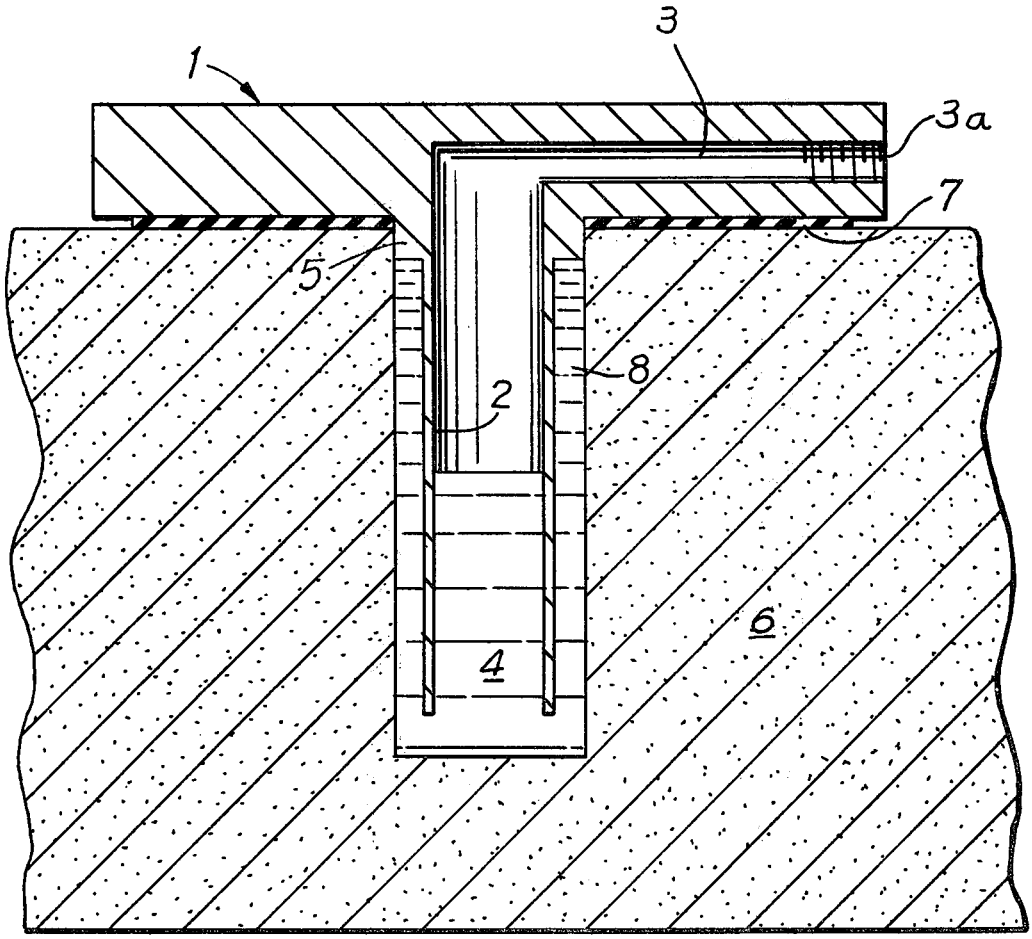
1
3
3a
7
5
8
2
6
4

METHOD OF SEALING POROUS MATERIAL DEFINING A RECESS

BACKGROUND OF THE INVENTION

1. Field of the Invention

The method herein described is used to effectively seal pores in the material in the vicinity of recesses in porous materials (such as electrolytic cell anodes), which are used in corrosive environments and in which recesses connections to metal conductors are made, to prevent corrosion of the metallic conductors due to permeation of the porous material by corrosive components of the environment.

2. Description of the Prior Art

Special techniques are currently used to achieve an electrical contact to mercury cell anodes. These techniques often involve the use of a multiple connecting plug where a highly impregnated graphite plug is inserted between the graphite anode and the metal connector. This plug causes a high, power consuming, voltage drop and is complex to assemble.

Anodes which are used in cathodic protection, are currently impregnated with paraffin or linseed oil to protect the metal contact. However, the usual methods of impregnation do not give complete or uniform impregnation and problems of contact corrosion are still frequent.

Several U.S. patents relate to the general subject of impregnating carbon and/or graphite bodies but, none relate to impregnating recesses in graphite or other bodies in a manner and/or using an impregnating device, as taught in the present invention. Illustrative of such patents are the following: U.S. Pat. Nos. 1,861,415; 1,868,206; 1,909,800; 1,927,661, 2,207,734; 2,902,386; 3,167,447; 3,375,132; 3,529,997; 3,654,120.

SUMMARY OF THE INVENTION

An objective of this invention is to provide a method for uniformly impregnating the porosity surrounding a hole which is drilled into a porous material, and into which is inserted a metallic connector or conductor. One example of an installation in which this may be used is a piece of graphite which is to be used as an anode in a cell for the production of chlorine, and into which a hole is drilled and tapped so that a metallic electrical conductor can be screwed into the graphite to carry current to accomplish the desired electrochemical reactions on the surface of the graphite anode. The desired impregnation provided by the apparatus of this invention in such an installation is confined to or is mainly in the vicinity of the porosity surrounding the hole, thus not affecting the surface characteristics of the graphite. This effectively prevents brine from the chlorine cell from reaching the metallic conductor and thus prevents corrosion of the conductor by electrochemical processes which could occur at a metal/brine interface.

The achievement of the foregoing objective of a thoroughly impregnated region around the connecting hole, as this invention provides, also eliminates the need for the previously referred to special plug of the prior art and results in lower voltage drops and easier assembly.

The more thorough impregnation provided by the method of the present invention also thereby reduces the degree and frequency of the aforementioned contact corrosion problem.

BRIEF DESCRIPTION OF THE DRAWING

The invention will be better understood by reference to the drawing presented herewith which shows a vertical cross-sectional view of the "pressurization head" device in place for impregnation use in a piece of graphite.

DETAILED DESCRIPTION OF THE DRAWING

The device or apparatus consists of a plate 1, from the center of which a tube or tubular means 2 extends. Pressure conduit means 3, which is internally threaded at its inlet 3*a* at the edge of the plate, connects to the interior of the tube, so that when fluid (i.e. air) pressure is applied at the inlet of the hole on the edge of the plate, the pressure is transmitted to the interior of the tube. The tube is of such a length that it extends a predetermined distance, usually substantially to the bottom of the recess 8 in the porous material 6 in which it is inserted; and also has the important feature that its outside diameter is smaller than the inside diameter of the recess or "dead ended" or "blind" hole 8, which is drilled into the porous material 6, and into which the metallic connector will be inserted following the impregnation. By this means an annulus is formed between the outside tube wall and the inside hole wall. This annulus allows access of the impregnating fluid to all of the inside surface of the hole wall.

The pressurization head device typically has a planar surface on the underside of plate 1 and is also typically used with a porous material possessing a top planar surface so as to enable the formation of a pressure sealing relationship therewith through the application of mechanical pressure on the top of said plate. The device also is typically provided with a flange 5 at the junction of the tubular means 2 and the underside of plate 1, so that when the pressurization head device is inserted into the hole 8 in the porous material, the flange causes the tube to be centered in the hole to provide an annulus (between the tube and the hole wall) of uniform cross section.

The pressurization head also typically has the feature that a gasket 7 is attached to the underside or bottom surface of the plate, which surface is in contact with the surface of the porous material when the pressurization head is inserted in the hole. This gasket serves to seal the top surface of the porous material and thus prevents escape of the impregnating fluid 4. It is important that the gasket extend out radially from the tube at least as far as it is intended that the impregnating fluid should penetrate the porous material, since otherwise the impregnating fluid would escape from the top surface of the porous material before a sufficient volume of the porous material has been impregnated.

EXAMPLE OF OPERATION OF THE "PRESSURIZATION HEAD"

A. STEPS

The following is a detailed description of how the pressurization head is used to impregnate a porous body:

a. The "blind" hole or recess 8, which has been previously drilled into the porous body 6, is partially filled with the impregnating fluid 4;

b. The pressurization head device is inserted into the partially filled hole in the porous material. During insertion, the air in the tube is vented to the atmosphere through the hole 3 in the plate of the pressurization head, so that the impregnating fluid rises inside of the tube 2 which serves as a reservoir for the fluid;

c. Mechanical pressure is applied to the top of the plate 1 of the pressurization head, so that a tight seal is obtained between the gasket 7 of the pressurization head and the top surface of the porous material;

d. Gas pressure is applied to the interior of the tube by connecting a source of pressure to inlet 3*a* of the hole 3 in the plate. This causes the impregnating fluid in the tube to be forced into the annulus between the outside of the tube and the hole wall 8. Any air trapped above the impregnating fluid in the annulus will be forced out of the annulus through the porosity of the material allowing the impregnating fluid to completely fill the annulus. Due to the incompressibility of the fluids and the principles of hydraulic pressure, the gas pressure on the inside of the tube is transmitted through the fluid with the result that a uniform fluid pressure is exerted against all of the surface of the hole in the porous material. This uniform fluid pressure causes the fluid to fill the pores of the material around the hole with the result that a uniform impregnation of the pores is accomplished in the volume of material surrounding the hole;

e. The pressurization step is continued until the level of the fluid inside the tube has reached the bottom of the tube. The gas pressure is then released by venting the system to the atmosphere;

f. The pressurization head is then removed and any residue of impregnating fluid remaining in the hole is removed by pouring or by aspiration;

g. The metal connection to the hole is then made, such as by pouring a molten plug into the hole into which a connecting wire is inserted, or by threading the hole and screwing in a connector.

B. OPERATING CONDITIONS

The operating conditions required for this invention depend on the material being impregnated and the nature of the impregnating fluid. However, it is intended that one of the main uses for this invention is to impregnate graphite for use in electrochemical applications to prevent corrosion of metal contacts. Two specific applications reside in: (1) the assembly of anodes for use in mercury cells for the production of chlorine and caustic; and (2) for anodes used in conjunction with cathodic protection systems for corrosion prevention.

In both of these special applications it is comtemplated as a preferred practice that the impregnating fluid will be a thermoplastic resin or substance such as a coumarone-indene resin, paraffin, or chlorinated naphthalene or blend of such materials. In using these materials it will typically be necessary to heat the graphite, impregnating fluid, and pressurization head to a temperature above the softening point of the material being used. For example, when using the coumarone-indene resin Cumar R-16, (Cumar R-16 is a registered trademark of Neville Chemical Co. for a coumarone-indene resin having a softening point of 103° C. Ring and Ball), an impregnating temperature of about 155°–175° C is required to achieve sufficient fluidity for efficient impregnation.

As has been indicated, it is considered preferable that the impregnant should be thermoplastic for the types of application contemplated. It is also preferred that it have a viscosity at the temperature of impregnation in the range of about 150 to about 250 centipoise.

There is an interplay between the temperature, pressure and viscosity of the impregnant employed, and all must be controlled within a certain range or limits, which will be determined by the impregnant used, in order to achieve a satisfactory impregnation.

The data set forth in the following table illustrate this interplay. The impregnant used was a blend of seven percent sealing wax or paraffin in the Cumar R-16 coumarone-indene resin. The material being impregnated was graphite having an apparent density (A.D.) of 1.59 g./cm$^3$ and having a recess of predetermined size.

| Example | Impregnant Temp. °C | Impregnant Viscosity (in centipoise) | Impregnating Pressure | % Voids Filled Hole Surface | % Voids Filled ½" from Hole |
|---|---|---|---|---|---|
| 1 | 155 | 250 | 100 | 53 | 48 |
| 2 | 165 | 150 | 66 | 48 | 48 |

Each of the foregoing examples was considered as giving very satisfactory results. This was established by the fact that in each case water could not be forced out of the impregnated hole even when a pressure of 100 psi was applied to the water in the hole.

Among the major advantages of the "pressurization head" device of the present invention is that at the end of the impregnation, there is very little impregnant left in the hole to be cleaned out. This is because the tube or tubular means 2 of the device extends a distance into the hole substantially to its bottom. Without such tube or nipple, the alternatives are to end up with either a hole full of impregnant, or, if one allowed the hole to empty during impregnation, an uneven impregnation.

Having little impregnant left in the hole also has a definite advantage when it comes to cleaning out the residue, since it can be done with a steam blast. Also, if the hole remained full at the end of the impregnation, it would have to be emptied, which one might think could be done either by tipping, except that in many cases the pieces being impregnated are of substantial dimension, such as 4 feet long which would present a problem; or by aspiration, but that would likewise require inserting something similar to a tube or nipple into the hole, so that one would have to carry out two operations whereas in the present invention, this is accomplished in one.

With reference to advantages in cathodic protection applications, the current practice is to use lead to seal wires into their anodes. In the thermoplastic resin impregnated holes of the present invention, a liquified "white metal" alloy having a melting point no higher than the decomposition temperature of the impregnant, and which expands on cooling to seal the wires into the holes, is preferably employed. As to this, it was found that the use of such an alloy in holes in graphite impregnated according to the present invention results in lower contact resistance than does the lead in the graphite with unimpregnated holes of the prior art practice.

I claim:

1. A method of sealing the pores surrounding the interior walls of a recess in a porous material with a thermoplastic impregnating fluid which comprises:

a. partially filling said recess with the thermoplastic impregnating material in a fluid condition in amount compatible with the desired extent of impregnation;

b. inserting for a distance substantially to but short of the bottom of the recess a tubular element substantially smaller in outside diameter than the interior size of the recess to thereby leave an annulus between said tubular means and such recess;

c. centering said tubular element in the recess during insertion by inserting in the recess a flange means attached to and concentric with the tubular element and of substantially the same size and shape as that of the interior of the recess which will be in contact therewith when the tubular element is inserted in the recess;

d. pressure sealing the tubular element and flange means with respect to the top surface through which the recess extends by bearing against said top surface a gasket coextensive with a plate, which is substantially co-planar with said top surface of the porous material and in contact therewith when the tubular element is inserted in the recess, and substantially larger than the interior size of the recess to at least the desired radial extent of impregnation of the thermoplastic material; and e. forcing the thermoplastic impregnating fluid into the pores surrounding the recess of the porous material by means of pressurized gas which is transmitted to said fluid through a conduit in said plate which communicates with said tubular element.

2. The method of claim 1 wherein the porous material is graphite.

* * * * *